United States Patent [19]

Verley

[11] Patent Number: 4,496,079

[45] Date of Patent: Jan. 29, 1985

[54] COMBINATION LOCK FOR MULTIPLE FAUCETS

[75] Inventor: Donald Verley, Valencia, Calif.

[73] Assignee: McCann's Engineering and Manufacturing Company, Los Angeles, Calif.

[21] Appl. No.: 339,769

[22] Filed: Jan. 15, 1982

[51] Int. Cl.[3] ..... B67D 5/56

[52] U.S. Cl. ..... 222/129.1; 251/149.9; 137/607

[58] Field of Search ..... 222/129.1, 145; 137/614.05, 614.06, 607; 251/149.9

[56] References Cited

U.S. PATENT DOCUMENTS 3,540,476 11/1970 Fuerst ..... 251/149.9

3,800,826 4/1974 McCann ..... 137/614.05

FOREIGN PATENT DOCUMENTS 2615184 10/1977 Fed. Rep. of Germany ... 251/149.9

*Primary Examiner*—H. Grant Skaggs

*Attorney, Agent, or Firm*—Lyon & Lyon

[57] ABSTRACT

A combination lock is disclosed which is adapted to be attached to a counter or wall which has liquid dispensing lines disposed therein. The combination lock is further adapted to receive a nozzle assembly, which is operative to dispense fluids. The combination lock has multiple channels which are aligned with opposing multiple channels in the nozzle assembly when fitted to the combination lock. A movable locking element will in a first position permit removal of the nozzle assembly and in a second position simultaneously fix the nozzle assembly to the combination lock and permit fluid to flow from the multiple channels in the lock into the multiple channels in the nozzle assembly.

8 Claims, 7 Drawing Figures

COMBINATION LOCK FOR MULTIPLE FAUCETS

BACKGROUND

This invention relates to locking mechanisms and in particular those that are useful with liquid dispensing apparatus.

In dispensing fluids, such as soft drinks, it has been found convenient to provide a nozzle assembly which has a lever, wherein movement of the lever will cause activation of one or more valves to dispense the fluid. In the case of a softdrink dispensing nozzle assembly, there are two lines, one for the soft drink syrup, and one for the carbonated water. These two lines enter the nozzle assembly and meet at a mixing chamber, wherein the syrup and carbonated water are put in solution for dispensing. The syrup line and carbonated water line each have a solenoid and valve assembly associated therewith, which will permit passage of the respective fluid into the mixing chamber upon activation by the individual dispensing the fluid.

It is often necessary to clean the nozzle assembly or change the nozzle assembly depending upon the type of fluid that is being dispensed. In the past, this was a cumbersome and inefficient procedure. First, it was necessary to turn off the lines feeding the nozzle assembly at the storage tank. The nozzle assembly could then be disconnected from the feed lines and replaced. The fluid left in the feed lines often spilled during this procedure, creating both an unsightly and unsanitary condition.

It has long been known that a plurality of these nozzle assemblies could be mounted on a wall to permit the dispensing of multiple flavored fluids, such as soft drinks. As in the previous case, the removal of these nozzle assemblies from the wall for either cleaning or replacement, often created numerous problems.

In addition to cleaning and repair, it is often useful to remove the nozzle assembly from the supply lines for the purpose of permitting easy movement of the fluid dispensing apparatus. Again, numerous problems existed with regard to effectively shutting off the flow of fluid without waste or uncontrolled flow.

Lastly, many new types of nozzle assemblies have been developed for use in the dispensing of various fluids. It is thus desirable to have a rapid and sanitary procedure to change nozzle assemblies.

SUMMARY

The invention of the present application solves many of the problems previously incurred as a result of removing the nozzle assembly from the supply lines.

Briefly, the combination lock of the present invention has a housing which is adapted to be affixed to a wall or other platform having dual supply lines disposed therein. The housing is adapted to receive the dual supply lines and direct the flow from those supply lines into dual channels. On opposite ends of the channels from the supply lines are two output lines which are disposed in a manner to receive the channels used for supplying liquid to the nozzle assembly.

Movably attached to the housing is a locking element which is adapted to affix the housing to the nozzle assembly. Simultaneous with the affixing of the housing to the nozzle assembly, the locking element also, upon movement into a second position will cause pistons disposed within the channels to move to an upward position thereby permitting fluid to pass from the supply lines into the output lines and into the channels in the nozzle assembly.

The locking element is caused to move into the second position by an arm pivotably attached to the top of the locking element. The arm has a bent portion which upon rotation of the arm will cause movement of the locking element into the second position.

The pistons disposed within the channels are spring biased and disposed through the top of the locking element. Thus, in the unlocked state, the locking element is in the lower most position, whereby the nozzle assembly is not affixed to the housing and the pistons, movably secured to the locking element, are disposed in the channels in a manner whereby no fluid is permitted to pass from the supply lines through the channels and into the output lines.

Therefore, it is an object of the present invention to provide an apparatus for the quick and clean removal of a nozzle assembly from fluid supply lines.

It is a further object of the present invention to provide an apparatus which has the ability to simultaneously lock a nozzle assembly to a supply lines and, only in the locked state, permit passage of fluid into a nozzle assembly from the supply lines.

These and other objects, advantages and features of the present invention will become more apparent to those skilled in the art upon a closer reading of the description of the preferred embodiment, a review of the drawings filed herewith, and a review of the claims.

BRIEF DESCRIPTION OF THE PREFERRED EMBODIMENT

Figure 1:
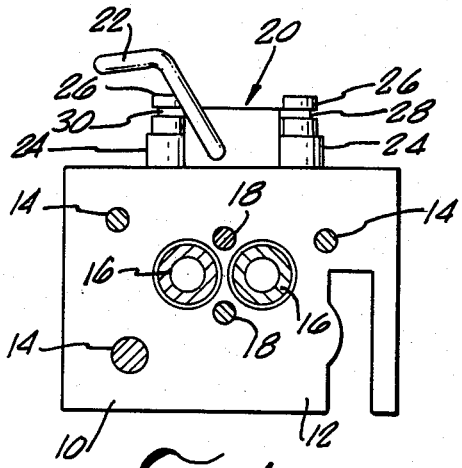
FIG. 1 is a back perspective view of the combination lock of the present invention.

Turning in detail to the drawings, in FIG. 1, the back side of the combination lock 10 of the present invention is shown as it faces the soft drink storage assembly or counter (not shown). Briefly, the combination lock has a housing 12, which in the preferred embodiment is made of a plastic material, however, it should be apparent to one of ordinary skill in the art that the housing may be made of metal which does not have a deleterious effect on the taste of the fluid passing through the housing. A plurality of threaded channels 14 are provided to secure the housing 12 to the wall or platform which contains the fluid storage supply lines (not shown). Substantially in the center of the housing 12 are dual supply lines 16 which have threaded channels 18 located therebetween to secure the supply lines 16 to the storage supply lines in the wall. These supply lines 16 are substantially cylindrical in form and are adapted to receive fittings from the storage supply lines.

It should be apparent that the storage supply line fittings may be provided with sealing elements to prevent the leakage of fluid. In another form of the invention, the supply lines 16 may be provided with annular seals (not shown) which when disposed within these supply lines 16 are operative to prevent the leakage of fluid between the storage supply lines and the supply lines 16.

The supply lines 16 are spaced apart a distance conventional in the soft drink dispensing industry. However, it should be apparant that various configurations are possible without departing from the scope of the present invention.

Slidably engaged with the housing 12 is a locking element 20 which supports a pivotable arm 22. The arm 22 is operative to move the locking element 70 from a first lower-most position to a second upper-most position.

A pair of cylinders 24 extend into the housing 12 and are affixed thereto by locking screws (not shown). The cylinders 24 open up into dual lock channels which extend further into the housing 12. A piston 26 is slidably disposed within each of the cylinders 24. The pistons 26 are secured to the locking element 20 by outwardly extending arms 28 of the locking element 20 which fit snugly within a groove 30 formed within the uppermost portion of each of the piston 26. The pistons 26 are thus adapted to reciprocate within the cylinders 24 upon movement of the locking element 20 under rotational action of the arm 22.

Figure 2:
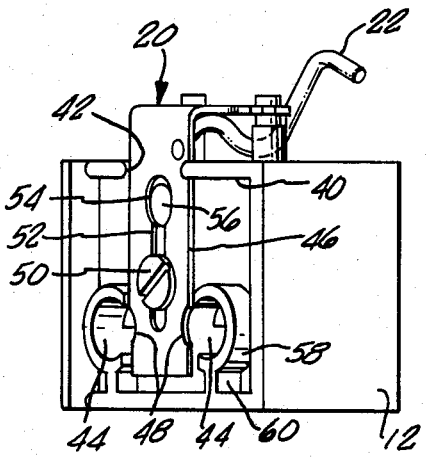
FIG. 2 is a front angled perspective view of the combination lock illustrating the output lines and locking element.

In FIG. 2 the front of the combination lock 10 is shown in an angled position. The housing 12 has a outwardly extending wall 40 which has a groove 42 formed in its centermost portion. The locking element 20 is fitted within the groove 42 and thus is capable of reciprocating movement within the groove 42 upon action of the arm 22.

In the lowermost portion of the housing 12 are defined two output lines 44 which are spaced apart such that the downwardly extending member 46 of locking element 20 is capable of being fitted therebetween. Within the lowermost portion of the downwardly extending element 46 of the locking element 20 are multiple grooves 48 which permit the formation of a circular configuration in the output lines 44 when the locking element 20 is disposed in the first or lowermost position. A screw 50 is secured to the housing 12 and is disposed within a slot 52 found in the centermost portion of the downwardly extending element 46. The slot 52 opens up into a oval shaped hole 54 which is also formed in the downwardly extending element 46. A registering orifice 56 is located within the housing 12 and is surrounded by the oval shaped hole 54 disposed within the downwardly extending element 46.

As is best shown in FIG. 2, the output lines 44 are formed of two upwardly extending ridges 58 which define the output lines 44. These upwardly extending ridges 58 have support walls 60 which add structural integrity to the housing 12.

Figure 3:
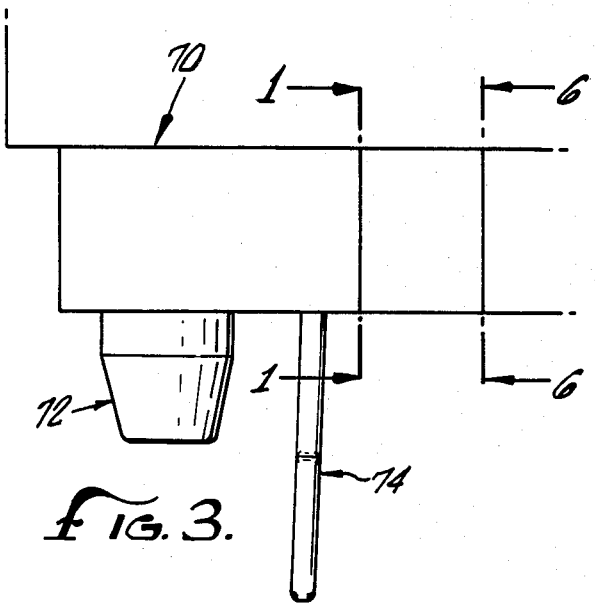
FIG. 3 is a side perspective view of a nozzle assembly.

In FIG. 3, the nozzle assembly 70 is shown in a side elevation view. Briefly, the nozzle assembly 70 has a downwardly extending nozzle 72 through which passes the fluid that is to be dispensed. Disposed rearward of the nozzle 72 is a activating lever 74 which is capable of limited pivotable movement with respect to the nozzle assembly 70. In the normal state, the lever 74 is spring biased toward the forward position, that is, toward the nozzle 72.

When it is desired to dispense fluid from the nozzle assembly 70, it is necessary to press the lever 74 such that it moves along an arc away from the nozzle 72. By moving this lever 74 in this manner, either with the operator's hand, or with the receptacle to which the fluid is being dispensed into, the solenoids (not shown) operative within the nozzle assembly 70, permit the opening of valves (not shown) and thus passage of the fluid out of the nozzle assembly 70. In the preferred embodiment, the nozzle assembly 70 has dual solenoids, which operate dual valves, one valve for carbonated water and the other valve for the syrup. It should be apparent that other forms of nozzle assembly 70 are operative with the present invention without modification.

Figure 4:
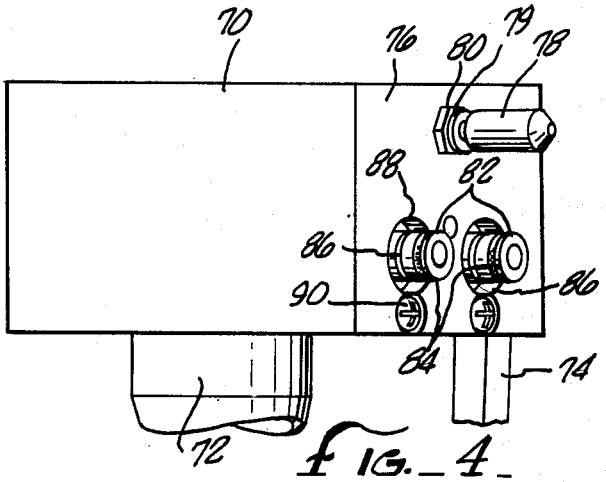
FIG. 4 is a back perspective view of the nozzle assembly illustrating the input channels to the nozzle assembly.

In FIG. 4, the nozzle assembly 70 is tilted in a manner to show the portion facing the combination lock 10. Briefly, at the uppermost portion of the face 76 is an outwardly extending pole 78 which is secured to the face 76 and the nozzle assembly 70 by a locking nut 80.

A groove 79 is placed along the pole 78 and is adapted to receive the locking element 20 for affixing the lock 10 to the nozzle assembly 70. At the lowermost portion of the face 76 are dual nozzle fittings 82 which have sealing rings 84 disposed entirely around their periphery and within grooves (not shown). The fittings 82 each have an annular groove 86 such that the grooves 86 are aligned with respect to each other. The fittings 82 are preferably made of a metallic material, such as aluminum, and are locked into channels 88 formed into the nozzle assembly 70. The fittings 82 are secured within the channels 88 by locking screws 90.

Figure 5:
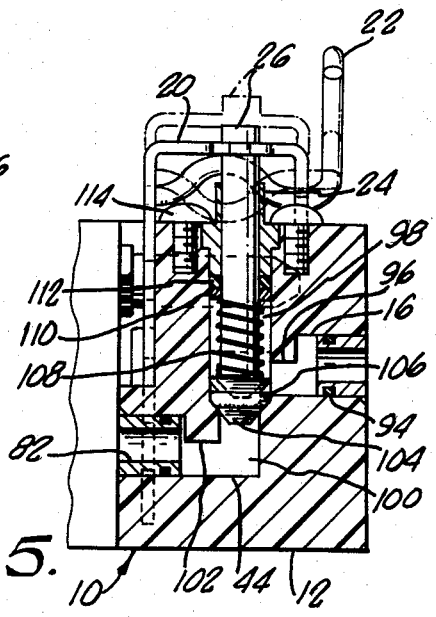
FIG. 5 is a side cross-sectional view of the combination lock illustrating the position of the supply lines, the lock channnels, and output lines with the spring biased pistons disposed in the lock channels.

In FIG. 5, a cross-section of the combination lock 10 of the present invention is illustrated. Briefly, the housing 12 has dual supply lines 16 bored therein. Extending into the supply lines 16 are fittings 92 which have sealing members disposed thereabout. These fittings 92 are connected to the storage supply lines which provide fluid for dispensing by the nozzle assembly 70. The supply lines 16 each have an inwardly extending shoulder 96 which assists in the formation of the channels 98 bored vertically into the housing 12.

On the opposite side of the housing 12 from the supply lines 16 are the output lines 44 which each have an upwardly extending portion 100 coaxial with the channels 98. Each output line 44 also has an inwardly extending shoulder 102 which is operative to define the maximum distance the fittings 82 may move into the output lines 44.

The pistons 26 are disposed within the cylinders 24 and descend into the channels 98 wherein they are capable of reciprocating movement. At the lowermost portion of each piston 26 is a angled tip 104 which has disposed thereabout a sealing element 106. Each piston 26 also has a spring 108 wrapped thereabout and restrained by a ring 110 which is disposed below a seal 112. The spring 108 urges the ring 110 and seal 112 upward toward the cylinder 24 which is locked into the housing by the screws 114. Thus, the pistons 26 are biased toward the lowermost position. As mentioned previously, the pistons 26 are attached to the locking element 20 by having arms 28 of the locking element 20 disposed within grooves 30 in each piston 26. Therefore, in the normal state, the spring 108 urges the piston 26 into the lowermost position, thus causing the locking element 20 to also be moved into the lowermost position.

In FIG. 5, the nozzle assembly 70 is juxtaposed the combination lock 10 and ready for use.

Figure 6:
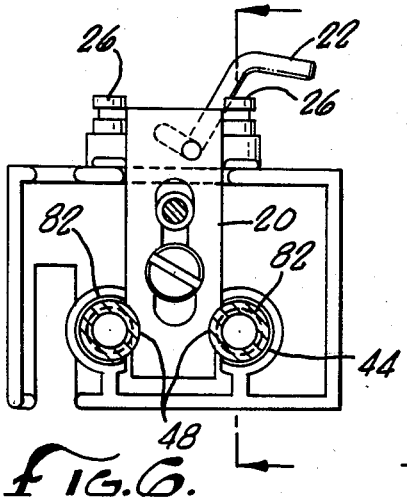
FIG. 6 is a front view of the combination lock illustrating the locking element in a first or unlocked position.
Figure 7:
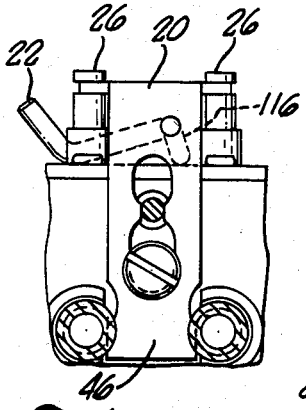
FIG. 7 is a front view of the combination lock illustrating the locking element in a second or locked position.

In FIGS. 6 and 7, the operation of the combination lock is illustrated. In FIG. 6 the lock is shown in the unlocked position. Briefly, the arm 22 is rotated into its inoperative position. At this point the locking element 20 is in the first or lowermost position, whereby the grooves 48 in the lowermost portion of the downwardly extending member 46 are positioned such that the output lines 44 form a circle with the surface of the groove 48. It is thus possible to place the fittings 82 into the output lines 44 as is shown in FIG. 5. It should also be noted in FIG. 6 that in the first or lowermost position the pistons 26 are also in their lowermost position with respect to the housing 12.

As shown in FIG. 7, the arm 22 is rotated into its operative position whereby the bent portion 116 moves along the top of the housing 12 thus causing the locking element 20 which suspends the pivotal arm 22 to move upward in response to the arm 22 rotation. As the locking element 20 moves from the first or lowermost position to the second or uppermost position two things simultaneously occur.

First, the downwardly extending element 46 of the locking element 20 moves upward thus causing the fittings 82 to be locked within the output lines 44. This is accomplished by having the downwardly extending element 46 fit into the grooves 86 defined within the fitting 84. Also, the downwardly extending element 46 is caused to move into the groove 79 of the post 78 thus securing the uppermost portion of the nozzle assembly 70 into the combination lock 10.

Second, the pistons 26, which are secured to the locking elements 20, are caused to move in an upward direction thus moving the seals 106 (as shown in FIG. 5) from the lowermost position to a position wherein fluid is permitted to pass from the supply lines 16 into the output lines 44.

It is only possible to activate the pistons 26, thus permitting fluid to pass into the nozzle assembly 70 when the nozzle assembly 70 is fully locked into place with respect to the combination lock 10. Any disalignment will result in the inability to open the channels 98 and thus permit fluid to pass into the output lines 44. By this procedure, the undesirable fluid waste and spillage customarily found in the present devices is eliminated.

It should be apparent to those skilled in the art that various configurations of output lines 44 can be utilized by simply modifying the shape of the locking element 20. Further, it should also be apparent that other devices may be used to bias the locking element 20 in the upward position without departing from the spirit of the present invention.

In using the combination lock of the present invention, first the housing 12 is secured to a wall having the fluid storage lines located therein. Once the fluid storage lines are connected to the supply lines 16 and the housing 12 is affixed to the wall, the nozzle assembly 70 may then be placed next to the combination lock 10, wherein the fittings 82 are supported within the output lines 44. After this is accomplished by rotating the arm 22 from its inactive position to its active position, the locking element 20 moves from its lowermost or first position to its uppermost or second position, thereby locking the nozzle assembly 70 to the combination lock 10 and opening up the channels 98 to permit fluid to flow from the input lines 16 to the output lines 44.

Numerous other modifications of the preferred embodiments disclosed above will suggest themselves to those of skill in the art. These may include not only variations in the type of materials but also variations in the size of the output lines and supply lines and also their number and configuration. Although the present device is useful in the soft drink dispensing industry, it should be understood that the device may also be used in various other industries, that is, those that require the controlled dispensing of fluid. Accordingly, it is intended that the scope of the present invention be limited only by that of the appended claims.

What is claimed is:

1. A lock assembly for rigidly attaching a nozzle assembly to a fluid source having a storage supply line, the lock assembly having a housing and a fluid supply line and a fluid output line with a lock assembly channel connecting the fluid supply line to the fluid output line, a nozzle assembly having a nozzle channel and a pole receivable into the housing to accommodate alignment of the nozzle channel with the fluid output line, the lock assembly further comprising:

a movable piston positioned within the lock assembly channel and biased into a position to close the lock assembly channel;

a locking element, said locking element connected to said piston, said locking element having a portion selectively adapted to engage the pole and retain the pole within the housing;

a movable arm pivotably attached to said locking element, said arm adapted to simultaneously cause engagement of said locking element portion with the pole to rigidly attach the housing to the nozzle assembly and to cause movement of said piston to open the lock assembly channel.

2. The lock assembly of claim 1, wherein the housing has two fluid supply lines and two corresponding fluid output lines and a lock assembly channel disposed between each corresponding fluid supply line and fluid output line.

3. The lock assembly of claim 2 comprising dual movable pistons adapted to close each of the lock assembly channels.

4. The lock assembly of claim 3 wherein the locking element comprises:

the first portion attached to each of the dual movable pistons;

a second portion, said portion having a slot, said slot incommunication with a hole larger in diameter than the diameter of pole, the second portion connected to the first potion;

wherein in a first position the pole is receivable into the housing through said hole and in a second position said second portion engages the pole to retain the pole in the housing.

5. The lock assembly of claim 4, wherein said second portion further comprises:

a reduced section, said reduced section adapted to receive a plurality of fittings integral with the nozzle assembly, each of said fittings having a groove, said second portion adapted to locate within said grooves upon movement of said arm from a first position to a second position to lock the nozzle to the housing.

6. A lock assembly for rigidly attaching a nozzle assembly to a fluid source having dual storage supply lines, the lock assembly having dual fluid supply lines and dual fluid output lines disposed within a housing, with a lock assembly channel disposed between interconnecting corresponding pairs of fluid supply lines and fluid output lines, a nozzle assembly having a protruding pole, the pole receivable into the housing to facilitate alignment of the fluid output lines with corresponding nozzle channels, the lock assembly comprising:

a locking element, said locking element having a first portion and a second portion;

dual movable pistons, each of said movable pistons dispose within one of said lock assembly channels, each of said pistons biased into a position to close said lock assembly channels, said pistons attached to said first portion of said locking element;

a movable arm, said movable arm attached to said second portion, said movable arm having a segment engageable with said first portion upon movement of said movable arm from a first position to a second position;

a slot formed within said second portion, said slot having an oval shaped hole incommunication therewith;

a screw attached to the housing, said screw disposed within said slot, said screw adapted to retain said second portion proximate said housing;

said second portion having a recessed section adapted to permit dual fittings integral with the nozzle to locate within said output lines;

said fittings each having a groove, said pole having a groove;

wherein movement of said arm from a first position to a second position simultaneously causes said second portion to engage said fittings and said pole and movement of said pistons to open said lock assembly channels.

7. A lock assembly for rigidly attaching a nozzle assembly to a fluid source having dual storage supply lines, the lock assembly having a housing with dual fluid supply lines and dual fluid output lines, the fluid supply lines selectively interconnected with the storage supply lines, dual lock assembly channels disposed within the housing and adapted to transmit fluid from the fluid supply lines to the fluid output lines, the nozzle assembly having a dual fittings receivable into the fluid output lines, the lock assembly further comprising:

a locking element, said locking element having a first portion and a second portion;

dual pistons, said pistons attached to said first portion, wherein said pistons are biased to close said lock assembly channels;

a rotatable arm, said arm attached to said second portion, said arm having a cam section wherein said cam section contacts said first portion upon rotatation of said arm from a first position to a second position;

said second portion having a slot formed therein said slot adapted to receive a pole integral with the nozzle assembly said pole having a groove formed therein, said fittings having grooves formed therein;

whereby rotation of said arm from a first position to a second position simultaneously causes said second portion to locate within said grooves to lock the nozzle assembly to the housing and facilitate movement of said pistons to open said lock assembly channels.

8. The lock assembly of claim 7, which includes a screw attached to the housing, said screw adapted to retain said second portion proximate the housing.

* * * * *